US008765350B2

(12) United States Patent
Matsuda et al.

(10) Patent No.: US 8,765,350 B2
(45) Date of Patent: Jul. 1, 2014

(54) METHOD OF MANUFACTURING TONER CARRIER, DEVICE FOR MANUFACTURING TONER CARRIER, TONER CARRIER, DEVELOPMENT AGENT, AND PROCESS CARTRIDGE

(71) Applicants: Yoshikatsu Matsuda, Shizuoka (JP); Kousuke Suzuki, Shizuoka (JP); Yuuki Mizutani, Kanagawa (JP)

(72) Inventors: Yoshikatsu Matsuda, Shizuoka (JP); Kousuke Suzuki, Shizuoka (JP); Yuuki Mizutani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/672,223

(22) Filed: Nov. 8, 2012

(65) Prior Publication Data

US 2013/0137028 A1 May 30, 2013

(30) Foreign Application Priority Data

Nov. 25, 2011 (JP) ..... 2011-257014

(51) Int. Cl.
*G03G 5/00* (2006.01)

(52) U.S. Cl.
USPC ..... 430/137.13

(58) Field of Classification Search
USPC ..... 430/137.13; 118/641; 399/252
See application file for complete search history.

(56) References Cited

U.S. PATENT DOCUMENTS

| | | | | |
|---|---|---|---|---|
| 5,491,042 | A * | 2/1996 | Sato et al. | 430/111.33 |
| 5,952,143 | A | 9/1999 | Ootaki et al. | |
| 2007/0231732 | A1* | 10/2007 | Shinmura et al. | 430/111.35 |
| 2012/0008979 | A1 | 1/2012 | Suzuki et al. | |
| 2012/0264042 | A1 | 10/2012 | Taikoji et al. | |

FOREIGN PATENT DOCUMENTS

| | | |
|---|---|---|
| JP | 5-341579 | 12/1993 |
| JP | 7-110603 | 4/1995 |
| JP | 10-097104 | 4/1998 |

* cited by examiner

*Primary Examiner* — Mark A Chapman
(74) *Attorney, Agent, or Firm* — Oblon, Spivak, McClelland, Maier & Neustadt, L.L.P.

(57) ABSTRACT

A method of manufacturing toner carrier formed of a core and a cover thereon, including the steps of: coating the core with a liquid cover containing a solvent and a material for forming the cover on the core in a processing tank; heating the core and the cover by first microwave radiation to volatilize the solvent from the cover; and removing the solvent volatilized in the step of heating from the processing tank.

18 Claims, 3 Drawing Sheets

METHOD OF MANUFACTURING TONER CARRIER, DEVICE FOR MANUFACTURING TONER CARRIER, TONER CARRIER, DEVELOPMENT AGENT, AND PROCESS CARTRIDGE

CROSS-REFERENCE TO RELATED APPLICATION

This patent application is based on and claims priority pursuant to 35 U.S.C. §119 to Japanese Patent Application No. 2011-257014, filed on Nov. 25, 2011 in the Japan Patent Office, the entire disclosure of which is hereby incorporated by reference herein.

BACKGROUND OF THE INVENTION

1. Field of the Invention

The present invention relates to a method of manufacturing toner carrier, a device for manufacturing toner carrier, toner carrier, a development agent, a process cartridge, a method of forming images, and an image forming apparatus.

2. Description of the Background Art

In electrophotography, images are formed by forming a latent electrostatic image by electrostatic charge on an image bearing member made of photoconductive materials, etc., attaching charged toner particles to the latent electrostatic image to obtain a visual toner image, transferring the toner image to a recording medium (typically paper), and fixing the toner image in place on the recording medium.

In recent years, the technologies regarding photocopiers and printers employing electrophotography have been rapidly developing from monochrome to full color, thereby expanding the full color market.

In color image formation employing full color electrophotography, three color toners containing toners of three primary colors of yellow, magenta, and cyan or four color toners including color of black in addition to the three color toners are laminated to represent all the colors.

Therefore, to obtain vivid full color images with excellent color representation, the surface of the fixed toner image is smoothed in some degree to reduce light scattering.

As a result, most of the image gloss of images produced by a typical full color photocopier, etc., ranges from moderate gloss to high gloss, e.g., 10% to 50%.

In general, as a method of fixing dry toner images on a recording medium, a contact heating fixing method is commonly used in which a heated roller or belt having a smooth surface is pressed against the toner.

This method is advantageous in terms of heat efficiency, fixing speed, and ability to import gloss and transparency to color toner.

However, since melted toner is peeled off from the surface of a heated fixing member after the melted toner contacts the surface under pressure, part of the toner image may remain attached to that surface, resulting in transfer of the attached toner to another recording medium on which another toner image is formed. This phenomenon is referred to as hot offset.

To prevent hot offset, a heating fixing member having a surface formed of materials having excellent releasability such as silicone rubber and fluorine resins is typically used and in addition a releasing oil such as silicone oil is applied to the surface of the heating fixing member.

This method is extremely effective to prevent hot offset of toner but requires a device to supply the releasing oil, thereby not shrinking but expanding the size of a fixing device. In an attempt to handle this drawback, with regard to monochrome toner, in addition to inclusion of a releasing agent such as wax in the toner, the viscous elasticity of the toner in melted state is improved by adjusting the molecular weight distribution of the binder resin to avoid fracturing of the melted toner from inside, which makes it possible to apply little or no releasing oil to the fixing roller.

Similarly, such an oil-free application method has become common in color toners to simplify the machines and make them more compact.

However, as described above, since the surface of a fixed image is required to be smooth to improve the color representation of color toner, toner in a melted state having a low viscous elasticity is suitable.

Consequently, color toner causes hot offset more easily than monochrome toner, which does not require gloss.

That means that it is more difficult to employ a method of applying little or no oil to the fixing roller in the case of color toner.

In addition, when toner particles containing a releasing agent are used, the attachability of the toner particles increases, thereby degrading the transferability of the toner to a transfer medium and resulting in contamination of triboelectric members such as toner carrier by the releasing agent in the toner particles, which leads to degradation of the chargeability and durability of the toner.

In addition, with regard to the toner carrier, to meet the increasing demand for more beautiful images, the size of the toner carrier particles is reduced while still being required to maintain the ability to continue to charge the toner.

On the other hand, as processing speeds increase, the stress on the toner carrier drastically increases.

Therefore, to improve the durability and the charging stability of the toner carrier, resin-coated toner carriers in which the surface of the core is covered with various resins are generally used.

However, development agents are usually subjected to stress caused by collisions between toner carrier particles due to stirring, friction between the development box and toner carrier particles, etc., which leads to the cover of the toner carrier particles being scraped or peeled off from the surface of the toner carrier particle core.

For example, when the cover of the toner carrier particle is scraped off and the inner cover exposed, the surface characteristics of the toner carrier particle tend to vary among the toner carriers particles, resulting in variance in the size of charge, which easily leads to toner fogging.

In addition, if the cover is deeply scraped or peeled off and the core exposes, the resistance of the toner carrier changes, which causes toner carrier attachment.

As one of the causes of the scraping and peeling-off of the cover of the toner carrier as described above, there is the solvent contained in the liquid cover that remains in the cover of the toner carrier.

That is, due to the solvent remaining in the cover of the toner carrier, the strength of the cover deteriorates so that the cover scrapes off easily.

Furthermore, solvent remaining between the core and the cover weakens the attachment between the core and the cover, which leads to peeling-off of the cover In a typical external heating system using hot air or a heater, the external portion of the cover starts drying first while the solvent on the core side of the cover cannot ooze through the cover and tends to remain therein.

In an attempt to solve this problem, Japanese Patent No. 3133854 (JP-H05-341579-A) describes baking toner carrier with microwave radiation, after a liquid cover is applied to the core of the toner carrier, to improve the attachment between the core and the cover by evenly transferring heat from the inside of the cover.

However, in the JP-3133854-B1 (JP-H05-341579-A) mentioned above, microwave radiation is used only in the baking process, not in the coating process to remove the solvent in the cover. Due to solidification of the cover during the application process, the solvent tends to be enclosed on the side closer to the core.

Consequently, it is found that the remaining solvent is not sufficiently removed even using the microwave heating.

SUMMARY OF THE INVENTION

In view of the foregoing, the present invention provides a method of manufacturing toner carrier formed of a core and a cover thereon, including the steps of: coating the core with a liquid cover containing a solvent and a material for forming the cover on the core in a processing tank; heating the core and the cover by first microwave radiation to volatilize the solvent from the cover; and removing the solvent volatilized in the step of heating from the processing tank.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
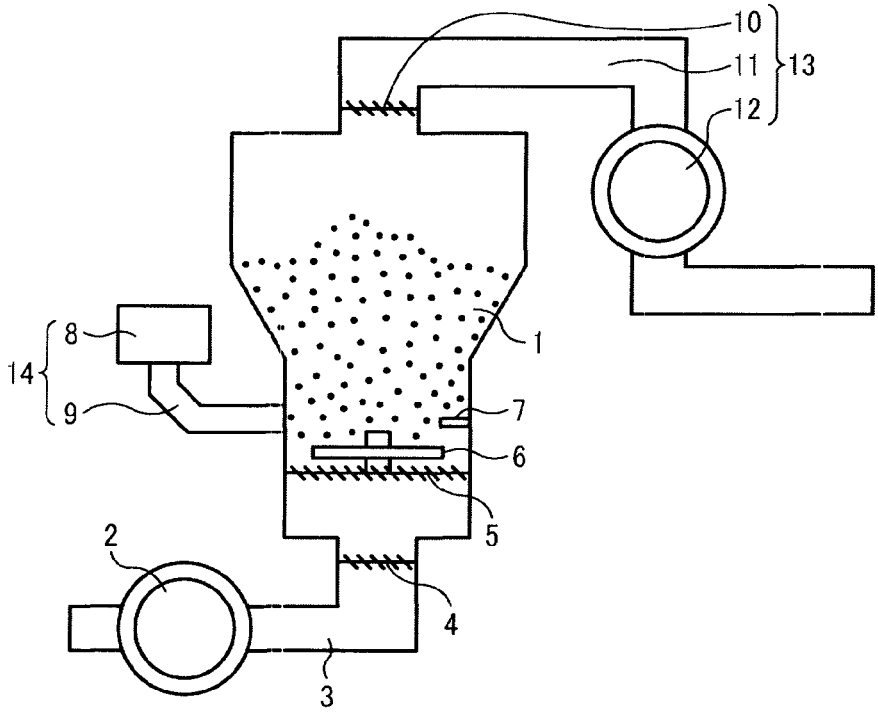
FIG. 1 is a schematic diagram illustrating an example of a device for manufacturing toner carriers of the present disclosure.

Next, the method of manufacturing the toner carrier of the present disclosure is described.

In the method of manufacturing toner carrier formed of a core and a cover (coating layer) thereon of the present disclosure, there are processes of coating the core with a liquid cover containing a solvent and a material (e.g., resin) for forming the cover on the core in a processing tank, heating the core by microwave radiation to volatilize the solvent from the cover; and removing the solvent volatilized in the step of heating from the processing tank.

According to the method of the present disclosure, the amount of the solvent remaining in the cover can be significantly reduced so that the toner carrier core and the coating resin are firmly attached to form a strong cover, thereby decreasing scraping and peeling-off of the cover.

To decrease scraping and peeling-off of the cover, it is necessary to lessen the amount of the solvent remaining in the cover.

As described above, since the cover tends to cure from the surface due to volatilization of the solvent, the solvent present closer to the core does not volatilize from the surface of the cover but is enclosed therein.

However, unless the solvent evaporates, the cover does not cure.

Therefore, it is difficult to have a good combination of the curing of the cover and the removal of the remaining solvent.

According to the method of manufacturing toner carrier of the present disclosure, it is possible to cure the cover and remove the residual solvent simultaneously.

The mechanism of reducing scraping and peeling-off of the cover is not clear but since the core itself generates heal by microwave radiation, the volatile component that degrades the attachment between the core and the coating resin is removed even if such a volatile solvent is originally attached to the core. Therefore, the attachability of the cover ameliorates.

On the other hand, since the liquid cover (liquid application of the cover) generates heat from inside and adheres to the heated core while increasing the viscosity without forming a layer outside that prevents volatilization of the solvent, the solvent in the liquid cover rapidly evaporates receiving the heat from the core as well.

Furthermore, in the present disclosure, it is inferred that the solvent tends not to remain in the cover because the volatilized material is removed from the system so that drying of the cover is accelerated without the partial pressure of the volatilized material reaching the evaporation pressure.

In particular, in a case of spray-coating, the fog drip of the liquid cover rapidly evaporates when it adheres to the core particle. Therefore, since the next fog drip adheres after the solvent in the fog drip evaporates, evaporation of the solvent is thought to continue.

In addition, in the process of coating the liquid cover for use in the present disclosure, the solvent is unlikely to remain. Therefore, a liquid cover having a low viscosity and containing a large amount of a solvent can be used and stably spray-coated to form a uniform cover.

The heating by first microwave radiation (first microwave radiation) means a heating method based on the principle applied to a microwave.

That is, irradiating a dielectric substance with microwave causes polarization everywhere therein, thereby generating charges on the surface of the dielectric substance. When the direction of the electric field changes at a rapid speed (high frequency), the dipoles reverse and the molecule receives friction with molecules around it.

Therefore, the dipoles cannot follow the changing speed of the electric field. As a result, the energy is consumed in the dielectric substance and heat is produced.

Electromagnetic wave ranging from 300 MHz to 30 GHz is used as the microwave frequency of the present disclosure.

However, the frequency allowed to use for industrial purpose is limited to Industry Science Medical (ISM) band. Therefore, the frequency of the microwave is from 890 Hz to 940 Hz or 2,400 Hz to 2,500 Hz.

The output power of the microwave of the present disclosure depends on the treatment amount of cores but is preferably from 1 kHz to 10 kHz and more preferably from 3 kHz to 5 kHz. When the output power is too small, the solvent may not sufficiently volatilize but some of it may remain. When the output power is too large, the solvent tends to evaporate excessively, thereby degrading the attachment to the cores. In addition, a PD value (microwave electric energy per unit of weight) (W/Kg) is required to be set in a suitable range to prevent cracking.

In addition, coating the core with the liquid cover of the present disclosure is conducted while removing the volatilized material from the system.

Any method that can remove the volatilized material from the system is suitable. For example, a method using a reduced pressure, an air flow into the system, an absorbent, etc. can be used. Using a reduced pressure or an air flow into the system is preferable.

Any method using a reduced pressure that can remove a volatilized material is suitable. For example, a vacuum pump is usable.

By reducing the pressure in the system, the boiling point of the volatile material lowers, thereby accelerating the removal of the volatile material.

In addition, the volatilized material (solvent) is discharged actively from the system (processing tank) due to the pressure difference so that the volatilized material does not saturate in the system. Consequently, the amount of the solvent remaining in the cover drastically decreases.

Using a flow of air that can remove a volatilized material is suitable. For example, a fluid bed device is usable.

An airflow in the system accelerates removal of the volatilized material from the system.

Atmospheric air can be used and dry air is preferable. The temperature of the air flow is preferably from 30° C. to 60° C. but can vary depending on the purpose.

Furthermore, with regard to the microwave radiation (first microwave radiation) described above, the output power thereof is preferably changeable.

There is no specific limit to the method of changing the microwave output power. By changing the microwave output power, it is possible to quickly raise the temperature to the target temperature without excessively heating the core and the material of the cover, thereby drastically reducing the solvent remaining in the cover.

Furthermore, it is preferable to coat the core with the liquid cover while stirring the core. Coating the core with the liquid cover while stirring the core makes it possible to irradiate the core and the liquid cover all over with microwave radiation, thereby evenly drying the cover of the toner carrier.

Any stirring method that can stir the core is suitable. For example, a rotatable stirrer is usable.

Any known method of coating the core with the liquid cover is suitably used. For example, a spray-coating method, a dip coating method, and a brush-coating method are usable. Among these, a spray-coating method is preferable.

The method of manufacturing toner carrier of the present disclosure optionally includes a process of baking after the process of coating the surface of the core with the liquid cover.

An external heating system using an electric furnace or a microwave radiation system can be used as the method of baking.

In particular, baking by heating treatment using second microwave radiation is preferable because the amount of the solvent remaining in the cover drastically decreases.

The microwave radiation device for use in the process of coating the surface of the core with the liquid cover for the first microwave radiation can be used in the baking process by second microwave radiation.

Therefore, by using the same microwave radiation device, the processes of from coating the core with the liquid cover to baking can be continuously conducted.

The change in baking temperature depends on the resin for the covering but is preferably from 120° C. to 350° C. and lower than the decomposition temperature of the resin of the cover.

The upper limit of the temperatures is more preferably around 220° C. and the baking time is preferably from 5 minutes to 120 minutes.

Another embodiment of the device for manufacturing toner carrier of the present disclosure is described next.

The device for manufacturing toner carrier of the present disclosure has a processing tank, a coating device, a microwave generator, and a discharging path, emits microwave, and coats the toner carrier core with the liquid cover while removing the volatilized solvent from the system (processing tank).

FIG. 1 is a schematic diagram illustrating an example of the device for manufacturing toner carrier of the present disclosure.

As illustrated in FIG. 1, the device for manufacturing toner carrier has a processing tank 1 to form a toner carrier fluid bed, an air supplier which includes an inlet air blower 2 to supply air into the processing tank 1 from below through an inlet air path 3, an air heater provided on the discharging side of the air inlet path 3, and a shield net 4, a spray nozzle 7 to spray the liquid cover into the processing tank 1, and a discharging device 13 to discharge the air from the processing tank 1, which includes a discharging blower 12, an emitting path 11, and a shield net 10.

In addition, at the bottom of the processing tank 1, there are provided a stirrer 6 to swirl the toner carrier and a fluid bet mesh 5. Moreover, the coating device has a microwave generator 14 having an oscillator 8 and a waveguide 9 to emit microwave in the processing tank 1.

In the coating process in the device for manufacturing toner carrier, supply a toner carrier core in the processing tank 1; supply an air into the processing tank 1 from below the stirrer 6 via the inlet air path 3 by the inlet air blower 2; and form a powder fluid bed.

Thereafter, while spraying droplets of the liquid cover from the spray nozzle 7 situated in the powder fluid bed, heat the core and the droplets with microwave emitted by the microwave generator 14; and retrieve thus-obtained granulated materials (in which a resin is applied and dried on the surface of the toner carrier core) to supply them to the next process.

Discharge the air supplied from the inlet air path 3 by the discharging device 13. By adjusting the amount of the air supplied from the inlet air path 3 and the amount of air discharged by the discharging device 13, it is possible to reduce the pressure in the processing tank 1.

Figure 2:
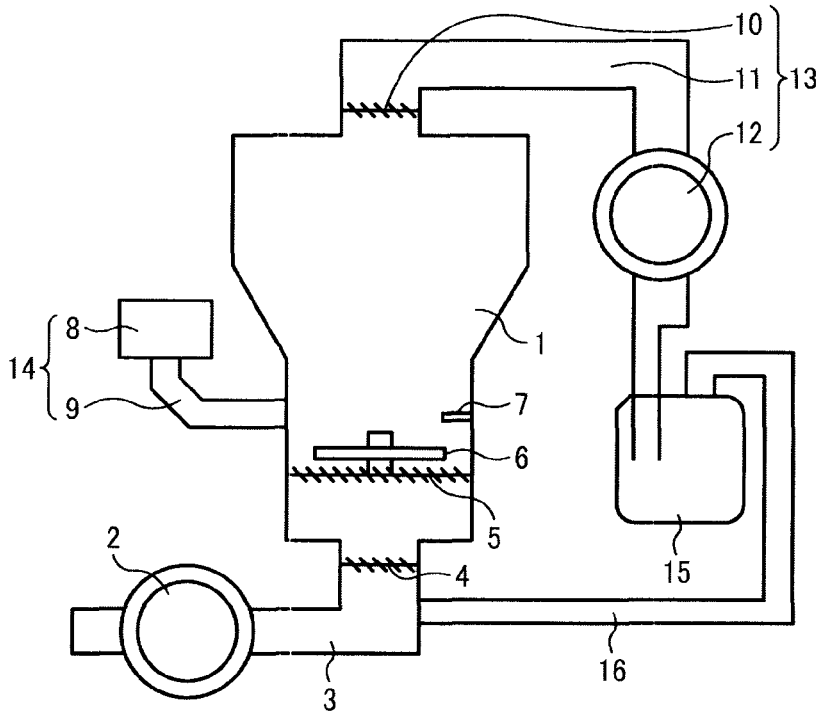
FIG. 2 is a schematic diagram illustrating another example of a device for manufacturing toner carriers of the present disclosure.

In addition, as illustrated in FIG. 2, it is suitable to provide a trap tube 15 and return the air to the air inlet path 3 via a circulation path 16 to partial circulation.

Next, the toner carrier of the present disclosure is described.

The toner carrier manufactured by the method of the present disclosure has at least a core and a cover and preferably the amount of solvent remaining in the cover is less than 30 ppm.

When the amount of the solvent remaining in the cover is within this range, the cover adheres to the toner carrier core firmly and has excellent scraping resistance and peeling-off resistance with a stable chargeability over an extended period of time.

Typical dielectric resins for use in the cover of a toner carrier can be used as the cross-linked resin that forms the cover of the toner carrier core of the present disclosure. Specific examples thereof include, but are not limited to, silicone resins, fluorine-containing resins, and acrylic resins. Among these, silicone resins are preferable.

The silicone resins have at least one of the repeating units represented by the following Chemical Structures 1.

Chemical Structures 1

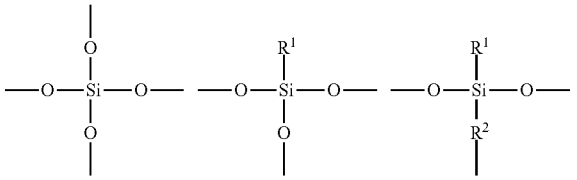

In the Chemical Structures 1, $R^1$ represents a hydrogen atom, a halogen Atom, a hydroxy group, a methoxy group, a lower alkyl group having one to four carbon atoms, or an aryl group (such as phenyl group and tolyl group) and $R^2$ represents an alkylene group having one to four carbon atoms or an arylene group (such as phenylene group).

The number of the carbon atoms in the aryl group is preferably from 6 to 20 and more preferably from 6 to 14.

Specific examples of the aryl group include, but are not limited to, aryl groups deriving from a condensed polycyclic aromatic hydrocarbon such as naphthalene, phenanthrene, and anthracene, and aryl groups deriving from chain polycyclic aromatic hydrocarbons such as biphenyl and terphenyl in addition to aryl groups (phenyl group) deriving from benzene. The aryl group that is substituted by a substitution group is included.

The number of the carbon atoms in the arylene group is preferably from 6 to 20 and more preferably from 6 to 14.

Specific examples of the aryl group include, but are not limited to, aryl groups deriving from a condensed polycyclic aromatic hydrocarbon naphthalene, phenanthrene, and anthracene, and aryl groups deriving from chain polycyclic aromatic hydrocarbons such as biphenyl and terphenyl in addition to aryl groups (phenyl group) deriving from benzene. The arylene group that is substituted by a substitution group is included.

Specific examples of the silicone resins include, but are not limited to, straight silicone resins formed of only organosiloxane bondings having the structure unit represented by the Chemical Structures 1 or alkyd-, polyester-, epoxy-, acrylic-, or urethane-modified silicone resins.

The straight silicone resins are available from the market and specific examples thereof include, but are not limited to, KR271, KR272, KR282, KR252, KR255, and KR152 (manufactured by Shin-Etsu CHEMICAL CO., LTD.); and SR2400, SR2406, and SR2411 (manufactured by DOW CORNING TORAY SILICONE CO., LTD.).

Specific examples of the modified silicone resins include, but are not limited to, epoxy-modified silicone resins, acrylic-modified silicone resins, phenolic-modified silicone resins, urethane-modified silicone resins, polyester-modified silicone resins, and alkyd-modified silicone resins.

Specific examples thereof include, but are not limited to, epoxy-modified resins (e.g., ES-1001N), acrylic-modified silicone resins (e.g., KR-5208), polyester-modified silicone resins (e.g., KR-5203) alkyd-modified silicone resins (e.g., KR-206), urethane-modified silicone resins (e.g., KR-305) (all of which are manufactured by Shin-Etsu CHEMICAL CO., LTD.); epoxy-modified silicone resins (e.g., SR2115); and alkyd-modified silicone resins (e.g., SR2110) (all manufactured by DOW CORNING TORAY SILICONE CO., LTD.).

The cover can be formed of the silicone resin and other resins in combination and the content of the other resins is preferably less than 40% by weight based on the total content of the entire resins.

Specific examples of the other resins include, but are not limited to, styrene-based resins such as polystyrene, polychlorostyrene, poly-α-methylstyrene, copolymers of styrene and chlorostyrene, copolymers of styrene and propylene, copolymers of styrene and butadiene, copolymers of styrene and vinyl chloride, copolymers of styrene and vinyl acetate, copolymers of styrene and maleic acid, copolymers of styrene and acrylic esters (such as copolymers of styrene and methyl acrylate, copolymers of styrene and ethyl acrylate, copolymers of styrene and butyl acrylate, copolymers of styrene and octyl acrylate, and copolymers of styrene and phenyl acrylate), copolymers of styrene and methacrylic esters (such as copolymers of styrene and methyl methacrylate and copolymers of styrene and acrylic esters (such as copolymers of styrene and methyl methacrylate, copolymers of styrene and ethyl methacrylate, copolymers of styrene and butyl methacrylate, and copolymers of styrene and phenyl methacrylate), copolymers of styrene-based resins such as styrene-α-chloro methyl acrylate and copolymers of styrene-acrylonitrile-acrylic ester, epoxy resins, polyester resins, polyethylene, polypropylene, ionomer resins, polyurethane resins, ketone resins, acrylic resins, copolymers of ethylene and ethyl acrylate, xylene resins, polyamide resins, phenolic resins, polycarbonate resins, melamine resins, and fluorine-containing resins. Among these, acrylic resins are preferable.

By having an acrylic-based resin skeleton, the core and particulates contained in the cover is firmly attached, thereby imparting excellent resistance to peeling-off of the cover. Therefore, deterioration such as scraping and peeling-off of the cover is prevented and the cover is stably maintained.

In addition, the acrylic-based resin skeleton can firmly hold the core and particles contained in the cover such as electroconductive particles by the strong attachability.

Such particulates make it possible to reinforce the cover.

Particulates formed of metal oxides are preferably used because the uniformity of the particle diameter is good and the cover is significantly reinforced.

In addition, the metal oxides are preferably oxides of Si, Ti, or Al. These can be used either alone or in combination.

The content of the particulates in the cover preferably ranges from 5% by weight to 100% by weight and more preferably from 10% by weight to 70% by weight based on the total mass of the resin solid portion in the cover.

The content is determined considering the particle diameter of the particulate and the specific surface. A content that is too small tends to fail to improve the abrasion resistance sufficiently and a content that is too large tends to cause detachment of particulates, resulting in deterioration of the chargeability over time.

The cover preferably has an average thickness of from 0.05 μm to 4 μm. When the average thickness is too small, the cover is vulnerable to stress, which results in scraping of the layer. When the average thickness is too large, the toner carrier easily adheres to an image because the cover is not dielectric.

Known toner carriers for a two component development agent for electrophotography are used as the core particles for the toner carrier of the present disclosure. Dielectric particles are preferable.

For example, iron, ferrite, magnetite, hematite, cobalt, iron-based metal, magnetite-based metal, Mn—Mg—Sr based ferrite, Mn-based ferrite, Mn—Mg ferrite, Li-based ferrite. Mn—Zn based ferrite, Cu—Zn based ferrite, Ni—Zn based ferrite, and Ba based ferrite can be used to form the core particles.

In the present disclosure, the core particle preferably has a weight average particle diameter of from 20 μm to 65 μm.

When the weight average particle diameter is too small, the toner carrier tends to cause attachment. When the weight average particle diameter is too large, the reproducibility of fine image portions may deteriorate, which results in failing to form fine images.

The weight average particle diameter can be measured by a microtrack particle size analyzer (model HRA 9320-X100, manufactured by NIKKISO CO., LTD.).

In addition, the toner carrier of the present disclosure preferably has a magnetization of from 40 $Am^2/kg$ to 90 $Am^2/kg$ in a magnetic field of 1 kOe ($10^5/4\pi$)(A/m). When this magnetization is too small, the toner carrier may adhere to an image. When this magnetization is too large, the magnetic filament tends to be hard, which causes blurring of an image.

The magnetization can be measured by using VSM-P7-15 (manufactured by TOEI INDUSTRY CO., LTD.).

Polymerized toner, which has been widely used in recent years, can be used as the toner for use in the present disclosure and typical pulverized toners can be also used irrespective of monochrome toner, color toner, and full color toner.

Furthermore, toner containing a releasing agent, referred to as oil free toner, can be also used. In general, oil free toner contains a releasing agent. Therefore, the releasing agent tends to be transferred to the surface of the toner carrier, which is referred to as "spent". The toner carrier of the present disclosure has excellent "spent" resistance so that the toner carrier can maintain good quality for an extended period of time.

In addition, since a soft resin is used for the oil free color toner to demonstrate excellent gloss, it tends to cause "spent" but the toner carrier of the present disclosure can be preferably used in combination with these toners.

Any known binder resin can be suitably used either alone or in combination for the toner for use in the present disclosure.

In addition, the toner for use in the present disclosure may contain a fixing helping agent, a coloring agent, and a charge control agent in addition to the binder resin described above. Therefore, such toner can be used in a fixing system (oil free system) having a fixing roll free from a toner fixation prevention oil. Any known fixing helping agents can be used.

Any known pigments and dyes that can obtain each color toner of yellow, magenta, cyan, and black can be used for the color toner for use in the present disclosure. These dyes and pigments can be used either alone or in combination.

The toner such as the color toner for use in the present disclosure may contain a charge control agent. Any known charge control agent can be used.

With regard to external additives, the transferability and the durability of the toner are improved by externally adding inorganic particulates such as silica, titanium oxide, alumina, silicon carbide, silicon nitride, and boron nitride and resin particulates to mother toner particles.

Such improvement is obtained by covering waxes that degrade the transferability and the durability with such an external additive and reducing the contact area by covering the surface of the toner particles with such particulates. Among these, inorganic particulates having a hydrophobized surface are preferably used.

Hydrophobized particulates of metal oxides such as silica and titanium oxide are suitably used.

As the resin particulates, polymethyl methacrylate and polystyrene particulates having an average particle diameter of from about 0.05 μm to about 1 μm obtained by a soap free emulsification polymerization method are preferably used.

Furthermore, a toner having a stable chargeability in a high moisture environment can be manufactured by using hydrophobized silica and hydrophobized titanium oxide in combination in an amount of the titanium oxide greater than that of the silica.

The durability of the toner can be improved by externally adding an external additive having a larger particle diameter than a typically used external additive such as silica having a specific surface area of from 20 $m^2/g$ to 50 $m^2/g$ and resin particulates having an average particle diameter of from one hundredth to one eighth of the average particle diameter of the toner.

This is because the metal oxide particulates externally added to the toner tend to be embedded into mother toner particles in the processes from charging the toner by mixing and stirring with the toner carrier to developing an image with the toner.

However, by externally adding an external additive having a larger particle diameter than these metal oxide particulates, the metal oxide particulates are prevented from being buried in the mother toner particles.

The inorganic particulates and resin particulates described above are less effective when contained inside the toner particles than when externally added.

However, the transferability and the durability are improved and in addition the pulverization property of the toner is also improved.

Furthermore, in combinational use of the external addition and the internal addition, the externally added particulates are prevented from being buried into the inside.

Therefore, the transferability is stable and excellent and the durability is also improved.

The toner for use in the present disclosure can be manufactured by any known method such as a pulverization method and a polymerization method.

In a case of the pulverization method, batch-type double rolls, Bumbury's mixer, continuation-type two-axis extruders such as a KTK type two-axis extruder manufactured by KOBE STEEL, LTD., a TEM type two-axis extruder manufactured by TOSHIBA, MACHINE CO, LTD., a two-axis extruder manufactured by ASADA IRON WORKS CO., LTD., a PCM type two-axis extruder manufactured by IKEGAI LTD., and a KEX type two-axis extruder manufactured by KURIMOTO LTD., and a continuation-type one axis kneader such as a Co-Kneader manufactured by COPERION BUSS can be preferably used as a device to mix and knead a toner.

The thus-obtained melted and kneaded mixture is thereafter cooled down followed by pulverization.

As to the pulverization, the melted and kneaded mixture is coarsely-pulverized by, for example, a hammer mill, ROTOPLEX, etc., and then finely-pulverized by a fine pulverizer using a jet air or a mechanical fine pulverizer.

It is preferred to pulverize the mixture in such a manner that the pulverized mixture has an average particle diameter of from 3 μm to 15 μm. Further, the pulverized mixture is preferred to be adjusted by, for example, an air classifier, in a manner that the size of the adjusted particles is from 5 μm to 20 μm.

Thereafter, external additives are externally attached to the mother toner. The external additives and the mother toner particles are mixed and stirred by a mixer, etc.

The external additives are pulverized and cover the surface of the mother toner particle. It is preferable to firmly and uniformly attach external additives such as inorganic particulates and resin particulates to the mother toner particle in terms of durability.

These are for illustration purpose only and the present disclosure is not limited thereto.

Process Cartridge

The process cartridge is a device (part) including an image bearing member (photoreceptor), a development device containing the carrier, and at least one device selected from other devices such as a charger, an irradiator, a transfer device, and a cleaner. It also can include other optional devices such as a discharging device.

Figure 3:
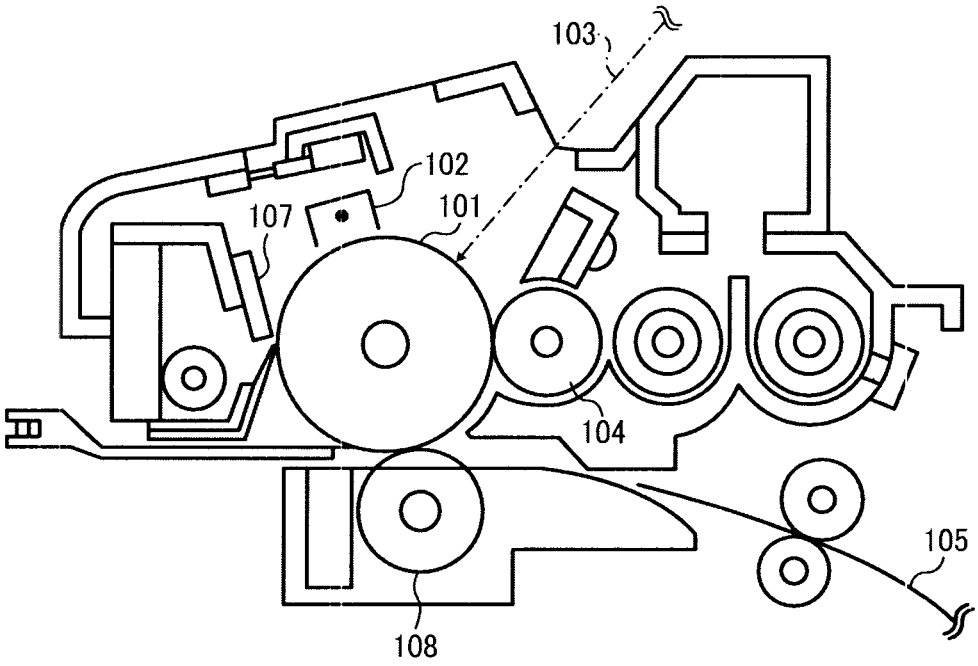
FIG. 3 is a schematic diagram illustrating an example of a process cartridge of the present disclosure.

There are varieties with regard to the forms of the process cartridge. A typical form thereof is as illustrated in FIG. 3.

The process cartridge includes, for example, an image bearing member 101, a charger 102, beams of light 103 emitted from an irradiator, a development device 104, a cleaner 107, and other optional devices. In FIG. 3, reference numerals 105 and 108 represent a recording (transfer) medium and a transfer device, respectively.

Image Forming Apparatus

Figure 4:
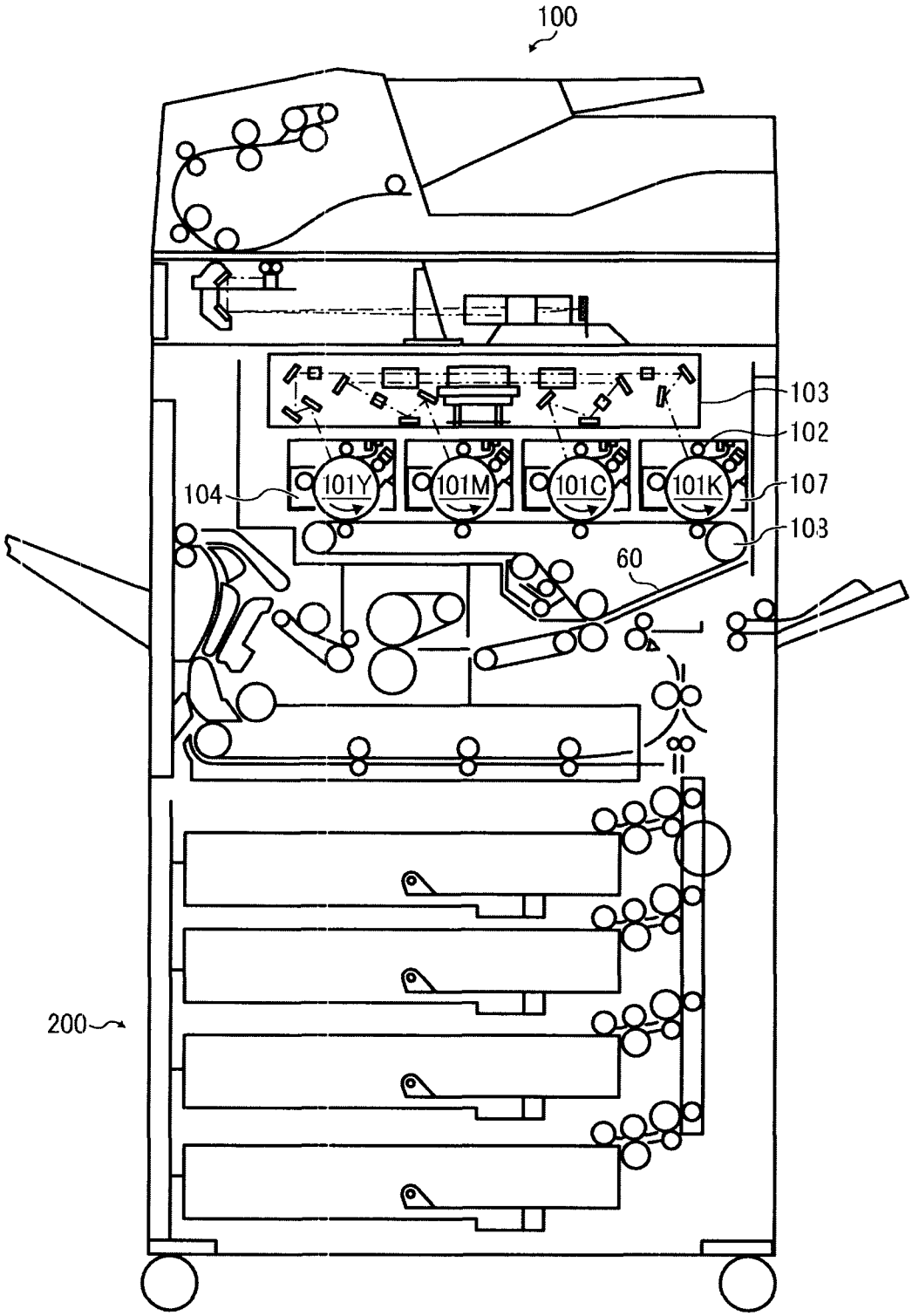
FIG. 4 is a schematic diagram illustrating an example of an image forming apparatus of the present disclosure.

FIG. 4 is a diagram illustrating a cross section of an example of an image forming apparatus 100 of the present disclosure. This is for illustration purpose only. The image forming apparatus of the present invention is not limited thereto.

A charger 102, an irradiator 103, a development device 104, a transfer device 108, and a cleaner 107 are provided around each of the image bearing drum (photoreceptor) 101 to form images by the following operation.

A series of the image formation processes are described using a negative-positive process.

The image bearing drum 101 is optionally discharged by a discharging lamp and uniformly charged with a negative polarity by the charger 102.

When the image bearing drum 101 (representing 101Y, 101M, 101C, and 101K) is charged, a voltage application mechanism applies a charging bias having a suitable DC voltage or a voltage in which an AC voltage is superimposed on the suitable DC voltage to the charger 102 such that the image bearing drum 101 is charged to a desired voltage.

A latent electrostatic image is formed on the charged image bearing drum 101 by a laser beam emitted from the irradiator 103 including, for example, a laser beam system. The absolute voltage at an irradiated portion is lower than the absolute voltage at a non-irradiated portion.

The laser beam is emitted from a semiconductor laser and reaches the surface of the image bearing drum 101 through a polygon mirror having a polygonal column that is rotating at a high speed to scan the surface in the rotation axis direction of the image bearing member.

The thus formed latent electrostatic image is developed by a development agent containing toner and the toner carrier described above supplied onto the development sleeve serving as a development agent bearing member included in the development device 104 to form a visual toner image.

When the latent image is developed, a voltage application mechanism applies a suitable development DC voltage or a bias in which an AC voltage is overlapped with the suitable development DC voltage to a development sleeve.

The toner images formed on the image bearing drum 101 corresponding to each color is transferred to an intermediate transfer body 60 by the transfer device 108 and furthermore transferred to a recording medium, typically paper, fed from a sheet feeding mechanism 200.

A voltage having a polarity reversed to that of the toner charging is preferably applied to the transfer device 108 as a transfer bias.

Thereafter, the intermediate transfer body 60 is separated from the image bearing drum 101 to obtain a transfer image.

In addition, the toner particles remaining on the image bearing drum 101 is retrieved into a toner collection room by the cleaning member of the cleaner 107.

A plurality of the development devices described above are contained in the image forming apparatus 100 and multiple toner images having a different color sequentially formed by the multiple development devices are sequentially transferred to a transfer material (recording medium) to obtain a superimposed color image.

Then, the superimposed toner image is conveyed to a fixing mechanism which fixes toner with heat, etc.

In addition, the charger 102 is preferably provided in contact with or in the vicinity of the surface of the image bearing drum 101 and a discharging wire is used in the charger 102. Therefore, the amount of ozone, which is produced during charging, is significantly reduced in comparison with a corona discharger such as corotron or scorotron.

In addition, the process cartridge described above can be mounted in the image forming apparatus 100.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but not limited thereto.

Example 1

Manufacturing of Toner Carrier

Disperse the recipe specified below by a Homomixer for ten minutes to prepare a liquid application of cover (liquid cover).

| | |
|---|---|
| Acrylic resin solution (Solid portion: 50% by weight) | 70 parts |
| Guanamine solution (Solid portion: 70% by weight) | 20 parts |
| Acid catalyst (Solid portion: 40% by weight) | 1 part |
| Silicone resin solution (Solid portion: 20% by weight) | 350 parts |
| Amino silane (Solid portion: 100% by weight) | 5 parts |
| Electroconductive-treated titanium particles (Surface: ITO treated, primary particle diameter: 50 nm, specific volume resistance: $1.0 \times 10^2\ \Omega \cdot cm$) | 165 parts |
| Toluene | 700 parts |

Use baked ferrite powder (DFC-400M) (Mn ferrite, manufactured by DOWA IP CREATION-DOWA IP CREATION CO., LTD.) having an average particle diameter of 35 μm as the core particle.

Next, form a cover on the surface of the core by a remodeled machine to which a microwave oscillator (manufactured by Micro Denshi Co., Ltd.) is connected to emit microwave toward a spira coater (manufactured by OKADA SEIKO CO., LTD.).

Circulate outside air at 30° C. in the spira coater using an inlet air blower and a discharging blower, while applying the liquid application of the coating layer to the surface of the core in such a manner that the thickness of the coating layer of the core is 0.3 μm and irradiate the layer with microwave having a frequency of 2,450 MHz and an output of 3 kW.

Keep the same condition for two minutes after completion of the application of the liquid application.

The temperature of the obtained toner carrier after this layer forming is 60° C. Place and bake this toner carrier in an electric furnace at 200° C. for one hour.

Cool down the thus-baked toner carrier and crumble it by using a shifter having an opening of 63 μm to obtain [Toner carrier 1] having an size of charge of 38-μc/g and a specific volume resistance of 14.0 Log(Ω·cm) and a residual solvent of 15 ppm.

Manufacturing Toner

Preparation of Master Batch

Mix and knead the following recipe with a two-roll at 70° C.

Raise the temperature of the roll to 120° C. and evaporate water to prepare a master batch.

| | |
|---|---|
| Binder resin: Polyester resin | 8 parts |
| Coloring Agent: C.I.P.Y 180 | 8 parts |
| Water | 4 parts |

Melt, mix, and knead the following recipe with a HENSCHEL MIXER with a two-roll at 120° C. for 40 minutes. Subsequent to cooling down, coarsely pulverize the mixture with a hammer mill, finely pulverize the resultant with an air jet pulverizer, and classify the finely pulverized powder to obtain mother toner particles having a weight average particle diameter of 5 μm.

| | |
|---|---|
| Binder resin: Polyester resin | 92 parts |
| Releasing agent: Carnauba wax | 5 parts |
| Charge control agent (E-84, manufactured by Orient Chemical Industries Co., Ltd.): | 1 part |
| Master Batch: | 16 parts |

Thereafter, add one part of silica having a hydrophobized surface and one part of titanium oxide having a hydrophobized surface to 100 parts of the mother toner particles followed by mixing by a HENSCHEL MIXER to obtain [Toner 1] (yellow toner)

Mix and stir 7 parts of the thus obtained [Toner 1] and 93 parts of [Toner carrier 1] to prepare a development agent having a toner concentration of 7% by weight.

Example 2

Form a coating layer on the surface of the core in the same manner as in Example 1 except that the static pressure in the spira coater is changed −500 kPa by adjusting the output power of the inlet air blower and discharging air blower.

The temperature of the obtained toner carrier after this layer forming is 60° C.

Thereafter, bake the toner carrier in the same manner as in Example 1 to obtain [Toner carrier 2] having an size of charge of 37-μc/g, a specific volume resistance of 13.9 Log(Ω·cm), and a residual solvent of 10 ppm.

Manufacture a development agent in the same manner as in Example 1 from the thus obtained [Toner carrier 2] and [Toner 1].

Example 3

Form a coating layer on the surface of the core in the same manner as in Example 1 except that the outside air at 30° C. circulated in the spira coater is changed to a dried air at 30° C.

The temperature of the obtained toner carrier after this layer forming is 60° C.

Thereafter, bake the toner carrier in the same manner as in Example 1 to obtain [Toner carrier 3] having an size of charge of 38-μc/g, a specific volume resistance of 14.5 Log(Ω·cm), and a residual solvent amount of 11 ppm.

Manufacture a development agent in the same manner as in Example 1 from the thus-obtained [Toner carrier 3] and [Toner 1].

Example 4

Form a coating layer on the surface of the core in the same manner as in Example 3 except that the frequency of microwave is changed from 2,450 MHz to 2,405 MHz.

The temperature of the obtained toner carrier after this layer forming is 55° C.

Thereafter, bake the toner carrier in the same manner as in Example 3 to obtain [Toner carrier 4] having an size of charge of 37-μc/g, a specific volume resistance of 14.0 Log(Ω·cm), and a residual solvent of 14 ppm.

Manufacture a development agent in the same manner as in Example 1 from the thus-obtained [Toner carrier 4] and [Toner 1].

Example 5

Form a coating layer on the surface of the core in the same manner as in Example 3 except that the frequency of microwave is changed from 2,450 MHz to 2,495 MHz.

The temperature of the obtained toner carrier after this layer forming is 6° C.

Thereafter, bake the toner carrier in the same manner as in Example 3 to obtain [Toner carrier 5] having an size of charge of 37-μc/g, a specific volume resistance of 14.1 Log(Ω·cm), and a residual solvent of 13 ppm.

Manufacture a development agent in the same manner as in Example 1 from the thus-obtained [Toner carrier 5] and [Toner 1].

Example 6

Form a coating layer on the surface of the core in the same manner as in Example 3 except that the microwave output power is changed to 5 kW in order that the temperature of the core and the liquid application of the coating layer reaches 60° C. in 30 seconds after the heating starts and controlled in a range of from 0 kW to 5 kW to maintain 60° C. thereafter.

The temperature of the obtained toner carrier after this layer forming is 60° C.

Thereafter, bake the toner carrier in the same manner as in Example 3 to obtain [Toner carrier 6] having an size of charge of 36-μc/g, a specific volume resistance of 14.3 Log(Ω·cm), and a residual solvent of 5 ppm.

Manufacture a development agent in the same manner as in Example 1 from the thus-obtained [Toner carrier 6] and [Toner 1].

Example 7

Form a coating layer on the surface of the core in the same manner as in Example 6 except that a stirrer is added to the bed of the spira coater to conduct stirring.

The temperature of the obtained toner carrier after this layer forming is 60° C.

Thereafter, bake the toner carrier in the same manner as in Example 6 to obtain [Toner carrier 7] having an size of charge of 37-μc/g, a specific volume resistance of 14.1 Log(Ω·cm), and a residual solvent of 1 ppm.

Manufacture a development agent in the same manner as in Example 1 from the thus-obtained [Toner carrier 7] and [Toner 1].

Example 8

Form a coating layer on the surface of the core in the same manner as in Example 7 except that the electric furnace is changed to microwave heating in the baking process to obtain [Toner carrier 8].

Microwave heating is conducted by using a remodeled spira coater under the conditions of a frequency of 2,450 MHz, an output of 5 kW, and an irradiation time of 10 minutes.

The temperature of the obtained toner carrier after this baking is 200° C. [Toner carrier 8] has an size of charge of 36-μc/g, a specific volume resistance of 14.2 Log(Ω·cm), and a residual solvent of 0.3 ppm.

Manufacture a development agent in the same manner as in Example 1 from the thus-obtained [Toner carrier 8] and [Toner 1].

Example 9

Form a coating layer on the surface of the core in the same manner as in Example 1 except that the microwave output power is changed to 5 kW in order that the temperature of the core and the liquid application of the coating layer reaches 60° C. in 30 seconds after the heating starts and controlled in a range of from 0 kW to 5 kW to maintain 60° C. thereafter.

The temperature of the obtained toner carrier after this layer forming is 60° C.

Thereafter, bake the toner carrier in the same manner as in Example 1 to obtain [Toner carrier 9] having an size of charge of 37 μc/g, a specific volume resistance of 14.1 Log(Ω·cm), and a residual solvent of 6 ppm.

Manufacture a development agent in the same manner as in Example 1 from the thus obtained [Toner carrier 9] and [Toner 1].

Example 10

Form a coating layer on the surface of the core in the same manner as in Example 1 except that the electric furnace is changed to microwave heating in the baking process to obtain [Toner carrier 10].

Microwave heating is conducted by using a remodeled spira coater under the conditions of a frequency of 2,450 MHz, an output of 5 kW, and an irradiation time of 10 minutes.

The temperature of the obtained toner carrier after this baking is 200° C. [Toner carrier 10] has an size of charge of 38-μc/g, a specific volume resistance of 14.1 Log(Ω·cm), and a residual solvent of 0.8 ppm.

Manufacture a development agent in the same manner as in Example 1 from the thus-obtained [Toner carrier 10] and [Toner 1].

Example 11

Change the coating device to a microwave granulator drier (manufactured by EARTHTECHNICA Co., Ltd.). Place the core and the liquid application of coating layer in the processing tank for dipping and irradiate the liquid with microwave having a frequency of 2,450 MHz with an output of 3 kW for eight minutes while rotating the stirrer and chopper wing under a reduced static pressure of −500 kPa to obtain [Toner carrier 11].

The temperature of the obtained toner carrier is 57° C.

Thereafter, bake the toner carrier in the same manner as in Example 1 to obtain [Toner carrier 11] having an size of charge of 33-μc/g, a specific volume resistance of 13.5 Log (Ω·cm), and a residual solvent of 27 ppm.

Manufacture a development agent in the same manner as in Example 1 from the thus-obtained [Toner carrier 11] and [Toner 1].

Comparative Example 1

Form a coating layer on the surface of the core in the same manner as in Example 1 except that circulating the outer air at 30° C. is stopped.

The temperature of the obtained toner carrier after this layer forming is 60° C.

Thereafter, bake the toner carrier in the same manner as in Example 1 to obtain [Toner carrier 12] having an size of charge of 38-μc/g, a specific volume resistance of 14.2 Log (Ω·cm), and a residual solvent of 34 ppm.

Manufacture a development agent in the same manner as in Example 1 from the thus obtained [Toner carrier 12] and [Toner 1].

Comparative Example 2

Form a coating layer on the surface of the core in the same manner as in Example 3 except that irradiation by microwave is stopped and the temperature of the dried air is changed from 30° C. to 60° C.

The temperature of the obtained toner carrier is 60° C.

Thereafter, bake the toner carrier in the same manner as in Example 3 to obtain [Toner carrier 13] having an size of charge of 36-μc/g, a specific volume resistance of 14.3 Log (Ω·cm), and a residual solvent of 152 ppm.

Manufacture a development agent in the same manner as in Example 1 from the thus obtained [Toner carrier 13] and [Toner 1].

Comparative Example 3

Form a coating layer on the surface of the core in the same manner as in Comparative Example 2 except that the electric furnace is changed to microwave heating in the baking process to obtain [Toner carrier 14].

Microwave heating is conducted by using a remodeled spira coater under the conditions of a frequency of 2,450 MHz, an output of 5 kW, and an irradiation time of 10 minutes.

The temperature of the obtained toner carrier after this baking is 200° C. [Toner carrier 14] has an size of charge of 35-μc/g, a specific volume resistance of 14.0 Log(Ω·cm), and a residual solvent of 91 ppm.

Manufacture a development agent in the same manner as in Example 1 from the thus obtained [Toner carrier 14] and [Toner 1].

The development agents prepared in Examples 1 to 11 and Comparative Examples 1 to 3 are used for evaluation with regard to the toner carrier attachment on a solid image over time and toner fogging.

The results are shown in Table 1.

TABLE 1

| | Size of charge (-μc/g) | Specific volume resistivity Log (Ω · m) | Amount of residual solvent (ppm) | Toner carrier attachment on solid image over time | Toner fog-ging |
|---|---|---|---|---|---|
| Example 1 | 38 | 14.0 | 15 | F | F |
| Example 2 | 37 | 13.9 | 10 | F | G |
| Example 3 | 38 | 14.5 | 11 | G | G |
| Example 4 | 37 | 14.0 | 14 | F | G |
| Example 5 | 37 | 14.1 | 13 | F | G |
| Example 6 | 36 | 14.3 | 5 | G | G |
| Example 7 | 37 | 14.1 | 1 | E | G |
| Example 8 | 36 | 14.2 | 0.3 | E | E |
| Example 9 | 37 | 14.1 | 6 | G | G |
| Example 10 | 38 | 14.1 | 0.8 | G | E |
| Example 11 | 33 | 13.5 | 27 | F | F |
| Comparative Example 1 | 38 | 14.2 | 34 | B | B |
| Comparative Example 2 | 36 | 14.3 | 152 | B | B |
| Comparative Example 3 | 35 | 14.0 | 91 | B | B |

Method of Measuring Size of Charge

The size of charge is measured by a blow-off method using TB-200 (manufactured by KYOCERA CHEMICAL CORPORATION) for a sample formed by mixing the toner carrier and the toner with a mixing ratio of 93% by weight of the toner carrier to 7% by weight of the toner followed by triboelectric charging.

Method of Measuring Specific Volume Resistance

The specific volume resistance is obtained by placing the toner carrier between parallel electrodes having a gap of 2 mm therebetween followed by tapping, apply ing DC 1,000 V between the electrodes, measuring the resistance after 30 seconds with a high resistance meter, and converting the measured resistance into the volume resistivity.

If the resistance is below the lower limit of the high resistance meter, the specific volume resistance is not obtained but treated as a breakdown.

Method of Measuring Residual Solvent

Place 1 g of the baked toner carrier in a gas chromatograph mass spectrometer (GCMS-QP-2010, manufactured by Shimadzu Corporation), measure the peak intensity ascribable to the solvent (i.e., toluene in Examples and Comparative Examples) contained in the coating material, and quantify the remaining solvent by using a standard curve indicating the relationship between the content of the solvent and the peak intensity.

Method of Evaluating Toner Carrier Attachment on Solid Over Time

Place the development agent in a machine remodeled based on a marketed product of a digital full color printer (imagio MP C5000, manufactured by Ricoh Co., Ltd.) and print a single color solid image on 400,000 sheets for evaluation. After the machine-running test, evaluate the toner carrier attachment in the development agent on the solid image.

The development agent on the solid image is evaluated by developing a solid image on an entire A3 paper with a fixed background potential of 150 V by the printer described above followed by observation with a magnifying lens to count the total number of non-printed portions on the image and the toner carrier particles actually attached to the image for evaluation.

Total Number of Non-Printed Portions on Image and Toner Carrier Particles Actually Attached to Image E (Excellent): 0 portions and particles G (Good): 1 to 5 portions and particles F (Fair): 6 to 10 portions and particles B (Bad): 11 or more portions and particles E, G, and F are acceptable and B is non acceptable.

Evaluation Method on Toner Fogging

Place the development agent in a machine remodeled based on a marketed product of a digital full color printer (imagio MP C5000, manufactured by Ricoh Co., Ltd.), output an A4 size image having an image area of 5% on a sheet per job 1,000 times, output an A3 size image having a 0% image area, and observe the state of the toner fogging for evaluation.

E (Excellent): No toner fogging seen

G (Good): Toner fogging hardly seen

F (Fair): Toner fogging slightly seen

B (Bad): Toner fogging clearly seen

E, G, and F are acceptable and B is not acceptable.

As seen in the evaluation results shown in Table 1, the development agents of Examples 1 to 11 are better than those of Comparative Examples 1 to 3 with regard to the toner carrier attachment on solid image over time and toner fogging.

What is claimed is:

1. A method of manufacturing toner carrier comprising a core and a cover formed thereon, comprising the steps of:

coating the core with a liquid cover comprising a solvent and a material for forming the cover on the core in a processing tank;

heating the core and the cover by first microwave radiation to volatilize the solvent from the cover; and removing the solvent volatilized in the step of heating from the processing tank.

2. The method of manufacturing toner carrier according to claim 1, wherein the step of heating and the step of removing are conducted at the same time with the step of coating.

3. The method of manufacturing toner carrier according to claim 1, wherein the step of removing is conducted under reduced pressure.

4. The method of manufacturing toner carrier according to claim 1, wherein the step of removing is conducted by circulating dry air.

5. The method of manufacturing toner carrier according to claim 1, wherein a microwave radiation output in the first microwave radiation is varied in the step of heating.

6. The method of manufacturing toner carrier according to claim 1, further comprising stirring the core during the coating step.

7. The method of manufacturing toner carrier according to claim 1, further comprising baking the toner carrier by second microwave radiation.

8. The method of manufacturing toner carrier according to claim 1, further comprising fluidizing the core during the step of coating.

9. Toner carrier manufactured by the method of claim 1.

10. The toner carrier according to claim 9, wherein a residual amount of the solvent in the cover is less than 30 ppm.

11. A development agent comprising:

the toner carrier of claim 9; and toner.

12. A method of forming an image comprising:

charging an image bearing member;

irradiating the image bearing member to form a latent electrostatic image thereon;

developing the latent electrostatic image with the development agent of claim 11 to obtain a visual image;

transferring the visual image to a recording medium; and cleaning a surface of the image bearing member.

13. An image forming apparatus comprising:

an image bearing member;

a charger to charge a surface of the image bearing member;

an irradiator to irradiate a surface of the image bearing member to form a latent electrostatic image thereon;

a development device to develop the latent electrostatic image with the development agent of claim 11 to obtain a visual image;

a transfer device to transfer the visual image to a recording medium;

a cleaner to clean the surface of the image bearing member; and a fixing member to fix the visual image on the recording medium.

14. A process cartridge comprising:

an image bearing member; and a development device including the toner carrier of claim 9.

15. An image forming apparatus comprising:

the process cartridge of claim 14.

16. A device for manufacturing toner carrier comprising a core and a cover formed thereon, comprising:

a processing tank;

a supplier to supply a liquid cover comprising a solvent and a material for forming a cover on the core in the processing tank;

a discharging device to discharge air from the processing tank; and a microwave oscillator to radiate microwave to heat the core material in the processing tank.

17. The device for manufacturing toner carrier according to claim 16, further comprising a stirrer to stir the core in the processing tank.

18. The device for manufacturing toner carrier according to claim 16, further comprising:

a fluid bed provided at a bottom of the processing tank; and an air supplier to supply air to the processing tank from below.

* * * * *